United States Patent [19]

Branch et al.

[11] 4,027,783

[45] June 7, 1977

[54] TALLYING BEVERAGE DISPENSER

[75] Inventors: William C. Branch; Oliver W. Cole; Robert P. Kidd, all of Dallas, Tex.

[73] Assignee: Booth, Inc., Carrollton, Tex.

[22] Filed: Aug. 28, 1975

[21] Appl. No.: 608,454

[52] U.S. Cl. ..... 222/26; 222/30; 222/129.3; 222/135; 235/94 R

[51] Int. Cl.[2] ..... B67D 5/24

[58] Field of Search ..... 222/30, 14, 26, 20, 222/129.3, 129.4, 135; 235/94 R, 201 ME

[56] References Cited

UNITED STATES PATENTS 820,197 5/1906 Hucks et al. ..... 235/94 R

FOREIGN PATENTS OR APPLICATIONS 18,435 8/1903 United Kingdom

*Primary Examiner*—Stanley H. Tollberg
*Attorney, Agent, or Firm*—Richards, Harris & Medlock

[57] ABSTRACT

Tally means for a liquid dispenser which selectively draws measured quantities of liquor for discharge through a discharge sprout. A liquid pressure responsive sensor is connected to the discharge line and is responsive only to passage of liquid. The sensor has a chamber with a diaphragm closing one end. A chamber inlet, larger than the outlet, leads through the end closed by the diaphragm. Because of differential in orifice size, liquid accumulates in the chamber causing the diaphragm to deflect but not respond to air flow. A piston in the chamber is moved by the diaphragm to actuate a tally apparatus to provide both printed record and a display of the number of drinks dispensed.

12 Claims, 12 Drawing Figures

TALLYING BEVERAGE DISPENSER

This invention relates to improvements in liquid dispensing apparatus, and more particularly to a tally system for a liquid measuring and dispensing apparatus.

In dispensing mixed liquid refreshments on vehicles such as airplanes, trains, buses and the like, automatic beverage dispensers such as those disclosed and claimed in U.S. Pat. No. 3,853,245 to William C. Branch and Jack J. Booth, issued Dec. 10, 1974, are used. Such dispensers utilize a positive displacement piston-cylinder system to insure proper portion control and to dispense liquids from a central supply.

The present invention involves the improvement of dispensing devices by providing an apparatus which for purposes of inventory and the elimination of pilferage can accurately tabulate and provide a record of the number of drinks dispensed. One problem presented in tabulation of the number of drinks dispensed is that the supply of liquid may become exhausted. In such case, the device may cycle without dispensing liquid. Any counting and recording apparatus which is responsive to either the initiation of a dispensing operation or cycling of the measuring portion of the dispenser cannot provide an accurate record of the number of actual quantities of liquids dispensed when a supply of liquid becomes exhausted.

To eliminate such problems, the present invention provides an improved sensor directly sensing the liquid flow. The sensor will not record a cycle when the dispenser is actuated and no liquid is present in the supply or when, for any other reason, no liquid flows through the discharge line.

In one embodiment, the discharge sensor comprises a chamber with fill and discharge ports. The discharge port is connected to the discharge dispensing line. A diaphragm extends across one end of the chamber, a piston contacts the diaphragm on the side opposite the ports and has a rod extending from the piston through an opening in the chamber. A follower engages the rod and a counter is connected to the follower. The counter is engaged by movement of the rod in response to deflection of the diaphragm. The respective fill and discharge ports of the chamber form orifices of a size with the discharge orifice smaller than the fill orifice. Thus, liquid will accumulate in the chamber when liquid flows through the discharge line which in turn will deflect the diaphragm and operate the counter. The size of the discharge and fill orifices are designed to allow air to flow through the discharge line without accumulating in the chamber. Thus, the flow of air through the line will not deflect the diaphragm a sufficient amount to operate the counter.

A printer is connected to the counter and is positioned adjacent to a plate movable by a cam surface whereby the reading on the printer may be imprinted on an instrument to provide a written record of the number of quantities of liquid dispensed by the device.

The novel features believed characteristic of the invention are set forth in the appended claims. The invention itself, however, as well as further objects and advantages thereof, will best be understood by reference to the following detailed description of an illustrative embodiment taken in conjunction with the accompanying drawings, in which:

Figure 1:
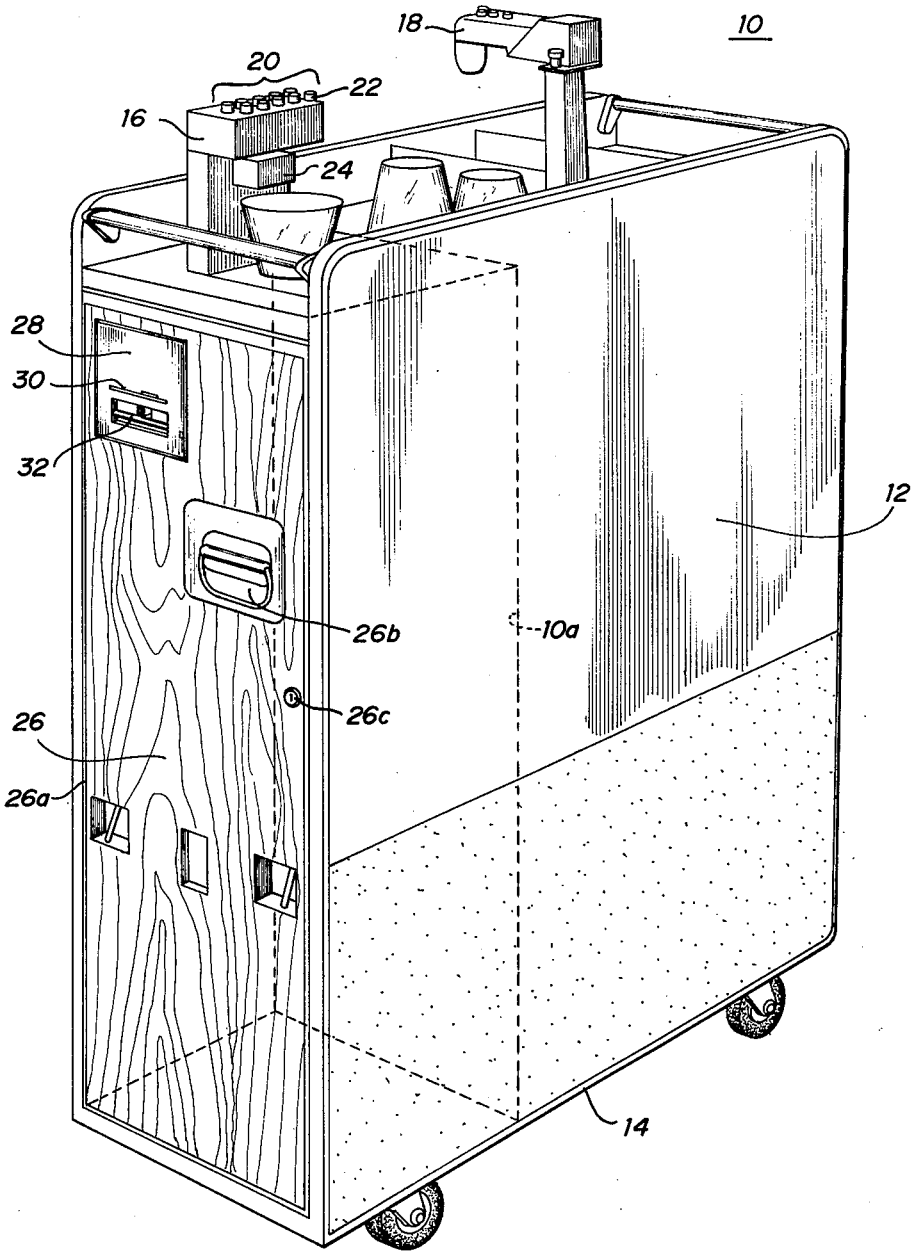
FIG. 1 is a perspective view of a dispenser incorporating the tabulator apparatus of the present invention.

Referring now to FIG. 1, a liquid dispenser is in the form of a portable cart 10 completely self-contained so that it may be moved along a narrow aisle as desired. Cart 10 contains a removable module 10*a* that fits into the end of the cart immediately below the top work surface. A plurality of liquid storage receptacles and dispensing apparatus are provided in module 10*a* for use selectively to dispense preselected measured amounts of liquids from the receptacles as desired. In addition, according to one aspect of the present invention, the module 10*a* has a tabulator and printer which tabulates the number of drinks dispensed and prints a record thereof.

Cart 10 has a housing 12 mounted on a wheeled frame 14. Dispenser spout assembly 18 is provided in the upper portion thereof. Drains, ice receptacles, cup storage structure and the like (not shown) is provided in the upper and rear portions of cart 10.

In a preferred embodiment, a dispensing spout assembly 16 is mounted on the top of module 10*a* and constructed similar to the liquid selector valve disclosed and described in U.S. Pat. No. 3,853,245.

Dispensing spout assembly 18 may comprise a control unit of the type described in U.S. Pat. to Jack J. Booth, No. 3,703,186, issued Nov. 21, 1972 and is shown for completeness though operation thereof does not involve module 10*a* or assembly 16.

For purposes of description of the present invention, it is noted that assembly 16 has a plurality of control buttons 20 connected by conduits leading from beverage storage units in module 10*a*. As described in the above-mentioned U.S. Pat. No. 3,853,245, a pressurized gas supply tank ($CO_2$ or Freon), syrup tanks and water tanks can be connected to the assembly 18 to dispense soft drinks. As described in U.S. Pat. No. 3,853,245, by pressing one of buttons 20, any of a plurality of selected liquors can be delivered by spout 24 along with mixers therefor.

Dispensing spout 18 as used to dispense carbonated liquids and the like does not require portion control. Dispensing spout 16 involved in the operation of the present invention is used for the purpose of dispensing alcoholic beverages. It requires portion control and accounting.

Each of the control buttons 20 on dispenser 16 is associated with a completely separate liquid source. Each button will select a different liquid. Thus, by depressing one of buttons 20, a selected liquor will be dispensed from one of several spouts in dispensing head 24.

Contained within module 10*a* are all the elements necessary for dispensing the various controlled liquids including dispensing valves, supply containers and other associated equipment to make the separate liquid dispensing systems.

Figure 2:
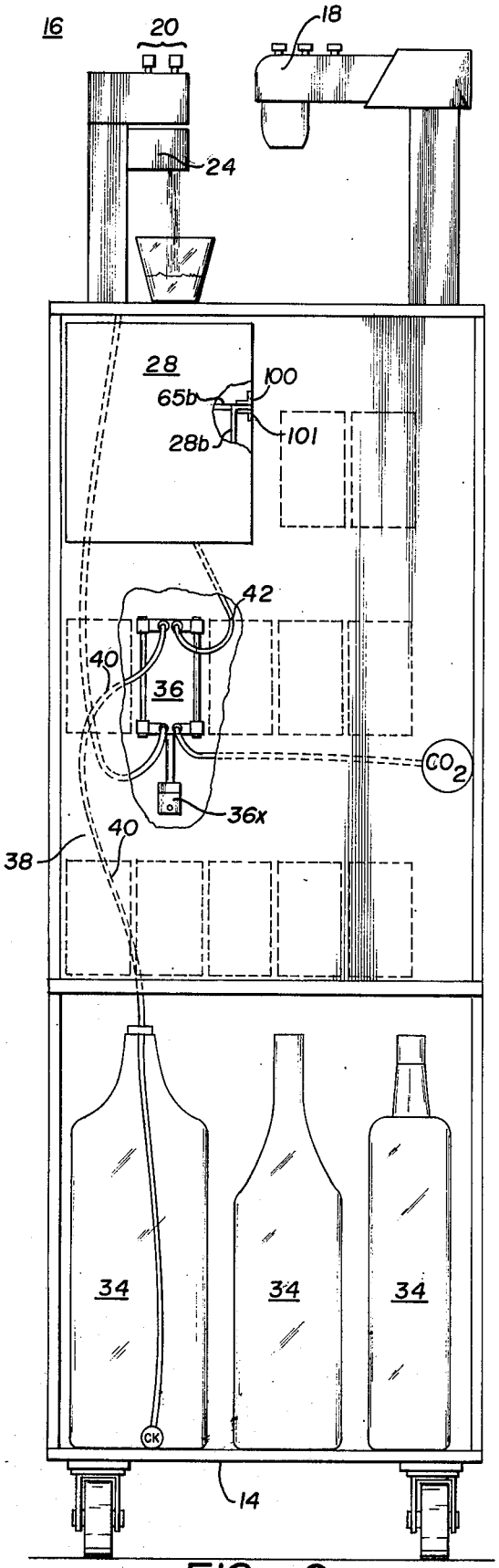
FIG. 2 is an end elevation of the dispenser of FIG. 1 with the end cover removed.

As can be seen in FIGS. 1 and 2, module 10*a* has door 26 which can be opened to expose the interior thereof and components therein primarily associated with dispenser 16. Other doors are provided in housing 12 for servicing and filling the various components of the systems associated with dispenser 18. Door 26 is hinged along line 26*a* to the frame of module 10*a* with a suitable latch and handle 26*b* and a lock 26*c*.

A tally recorder 28 is located in an opening in the upper left-hand corner of door 26. It is provided with a handle 32 which an operator may mechanically actuate to record a total registered on a counter in the unit 28. A slot 30 is provided through which an operator may insert a tally slip and an identification key in order to print the identification and a count of the number of drinks disposed on the tally slip. In addition, the identification and tally data are printed on a tape retained in recorder 28. Tally recorder 28 is mounted independently of door 26 so that it cannot be removed except with door 26 open as will further be described in detail.

A portion of the system associated with dispenser 16 is shown in FIG. 2 as exposed when door 26 is open. Containers 34, FIG. 2, rest on the bottom of module 10*a*. Each container 34 contains a separate liquid to be dispensed from unit 16. A dispensing and metering unit or pump 36 is mounted on a bulkhead 38 extending across module 10*a*. Like metering units (shown dotted) are provided, in number equal the number of selections provided by buttons 20 to dispense from a like number of bottles 34.

Dispensing unit pumps 36 preferably are of the type illustrated and described in U.S. Pat. No. 3,853,245. Consistent with FIG. 3 of said patent, conduit 40 is connected to one of containers 34 whereby liquids may be removed from said containers by operation of pump 36. Conduit 42 is connected through a liquid sensor assembly 44 behind tally unit 28 to dispenser unit 16. Liquid from bottle 34 is transferred through pump 36 and sensor assembly 44 by a dispensing spout in unit 24.

It is to be understood that other types of valves could be used in place of pump 36. For purposes of this application, it is only important that each pump 36 be of a positive displacement type.

Figure 3:
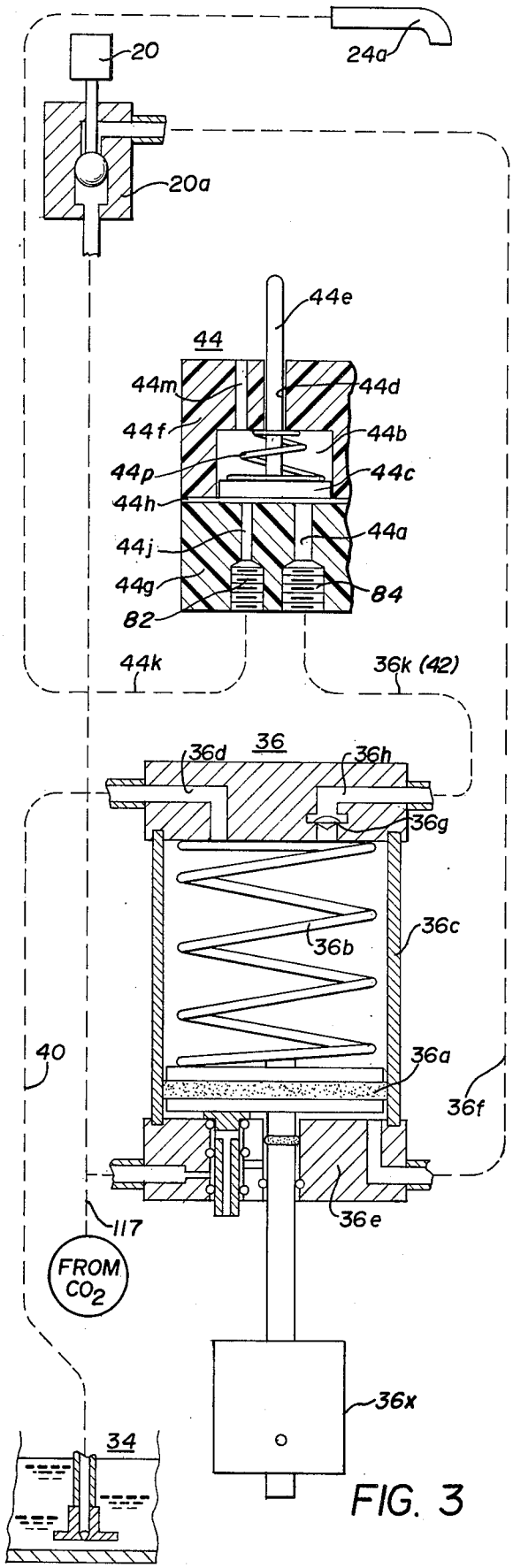
FIG. 3 is a schematic view of a dispenser embodying the invention.

The metering system is schematically illustrated in FIG. 3. Metering pump 36 comprises a piston 36*a* normally forced downward by a spring 36*b*. Piston 36*a* is in liquid tight contact with the walls of a cylinder 36*c*. Movement of the piston 36*a* downward and with the force of spring 36*b* causes liquid be sucked, by way of line 40, from container 34. The liquid passes through inlet channel 36*d*. The amount of liquid depends upon the active volume of the cylinder 36*c* as determined by the setting of an adjustable collar 36*x*. A set of valves in the lower end 36*e* of the unit 36 are actuated under the control of pressure from a gas container. Line 36*f* (shown dotted) leads to an inlet in the bottom 36*e* from a valve unit 20*a* associated with the button 20. Valve unit 20*a* is connected by way of an inlet line 20*b* from the pressurized gas source. When button 20 is momentarily depressed, the pressure in line 36*f* causes the piston to start to move upward. This serves to permit pressurized gas from line 117 to elevate piston 36*a* driving fluid therefrom through a check valve 36*g* in an outlet channel 36*h*.

In accordance with the present invention, the outlet channel 36*h* is connected by way of a tube 36*k* (shown dotted) which leads to one chamber of a multi chamber liquid flow sensor unit 44. More particularly, line 36*k* is connected to an inlet channel 44*a*. Channel 44*a* leads to a chamber 44*b* in which there is located a piston 44*c* with the stem of the piston extending upwardly from the chamber 44*b* through a passage 44*d* so that the upper end 44*e* protrudes above the upper surface of the unit 44. The unit 44 is comprised of two plates. The upper plate 44*f* has the chamber 44*b* formed therein. The chamber 44*b* is closed by a rubber diaphragm 44*h* which is clamped to plate 44*f* by the lower plate 44*g*.

Thus, as the piston 36*a* moves upwardly forcing liquid through line 36*k*, diaphragm 44*h* is distorted so that the liquid may then pass laterally to the outlet 44*j*. The outlet 44*j* is then connected by way of a tube 44*k* (shown dotted) which leads to a dispensing nozzle in a nozzle block 24, FIG. 1.

In accordance with the present invention, the inlet channel 44*a* is larger than the outlet channel 44*j* so that there will be a differential pressure built up within chamber 44*b* to distort the diaphragm 44*h* and move piston 44*c* in opposition to a spring 44*p*. The upper end 44*e* thereof is then caused to contact a tally actuator as will later be described.

In operation, the containers 34 normally are loaded into the compartment behind door 12 and suitably connected through the pumps 36 to dispensing spout unit 16. A counter in tally unit 28 would then be set to its desired initial condition and the unit placed in a positioning rack for alignment with the opening in door 26. The door is then closed and locked so that the compartment behind the door 26 would not be accessible to operating personnel and would be accessible only to service and accounting personnel.

In a preferred embodiment, the input orifice was 0.125 diameter while the discharge orifice was 0.062 diameter.

Referring again to FIG. 3, the difference between sizes of the orifices 82 and 84 will prevent liquid from leaving the space under diaphragm 44*h* as fast as it enters forcing diaphragm 44*h* to deflect upward to provide space to accumulate liquid. Air displaced from the chamber 44*b* above diaphragm 44*h* will vent through port 44*m*. Once liquid accumulated under diaphragm 44*h* has been discharged through conduit 44*k*, the diaphragm will return to the position shown in FIG. 3 and piston 44*c* will follow it down under the force of spring 44*p*.

Ports 44*a* and 44*j* are sized such that when container 34 is empty and only air is pumped into the system by the action of the piston 36*a*, the flow of air through the conduit 36*d* will not cause the diaphragm to be substantially deflected upward. This is due to the fact that air flowing through the smaller discharge port has low viscosity and does not accumulate under diaphragm 44*h*. Thus when a supply bottle is exhausted, no liquid is dispensed by the apparatus even though pump 36 is cycled. Diaphragm 44*h* will not cause rod 44*e* to move upward.

Figure 4:
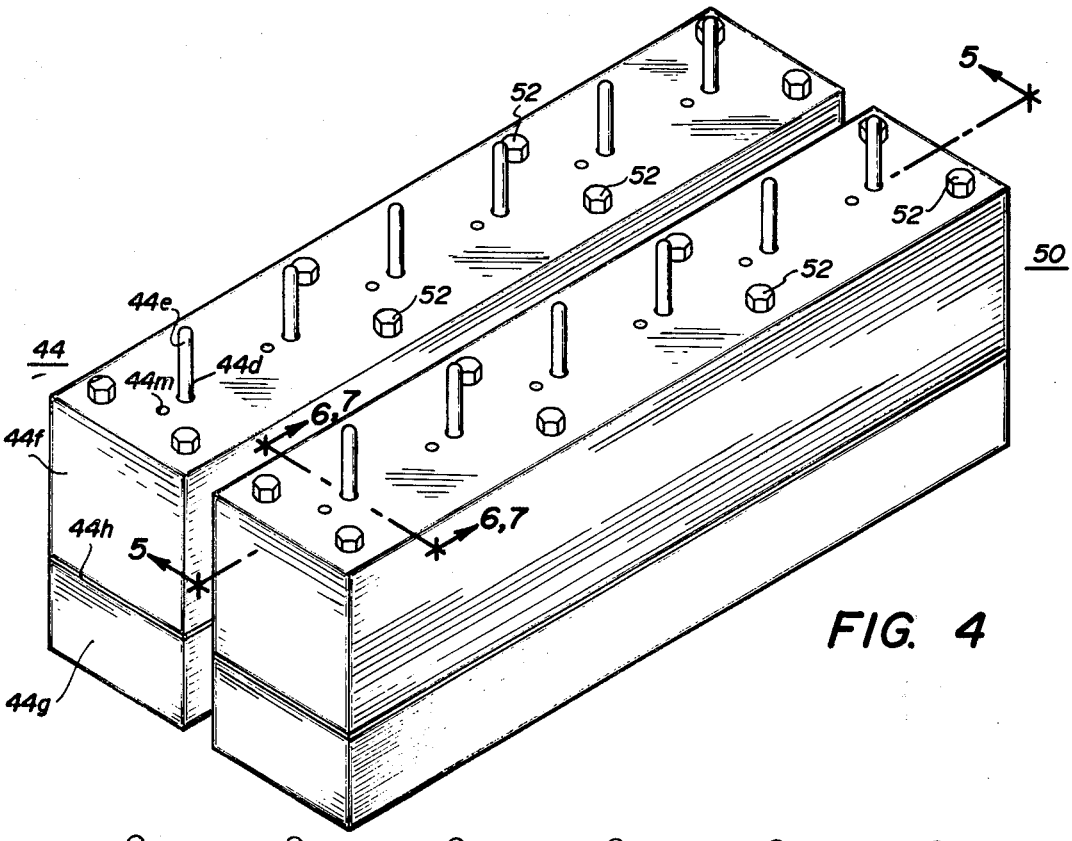
FIG. 4 is an isometric view of two sensor blocks.
Figure 5:
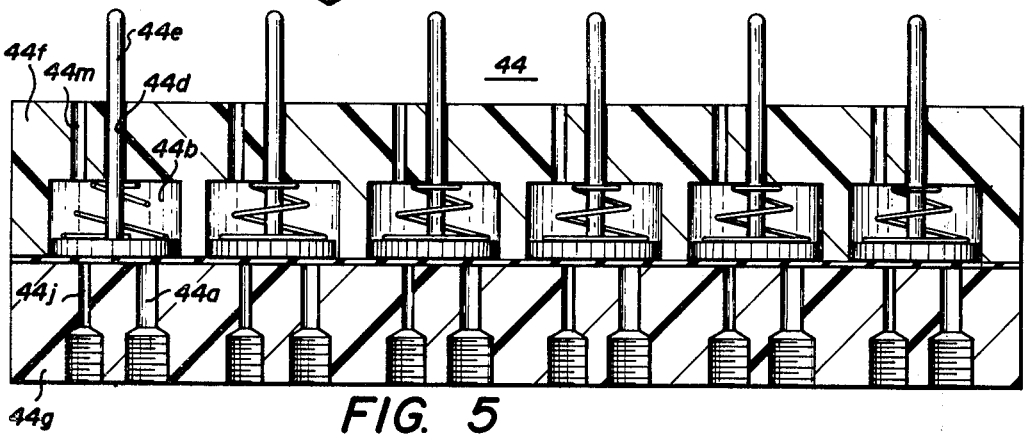
FIG. 5 is a sectional view of a sensor block taken along lines 5—5 of FIG. 4.

Further details of sensor assembly 44 are illustrated in FIGS. 4 and 5. Sensor assembly 44 has six channels.

A companion assembly also has six channels. Bolts 52 connect the upper and lower plates 44*f* and 44*g* together and compress the diaphragm 44*h* therebetween.

Upper plate 44*f* has six separate cylindrical chambers 70 therein. Each of these chambers 70 has an axially extending opening which extends through plate 44*f*. Rods such as rod 44*e* each carry a piston and extend through plate 44*f*.

The lower plate 44*g* is provided with six pairs of discharge and input ports. Thus, the two block shaped sensors 44 and 50 provide for a total of 12 channels thus accommodating the selection of any of 12 different beverages. The view shown in FIG. 3 of the assembly 44 is taken along line 6—6 of FIG. 4. A sectional view of the entire sensor block, as taken along line 5—5 of FIG. 4, is shown in FIG. 5.

Figure 6:
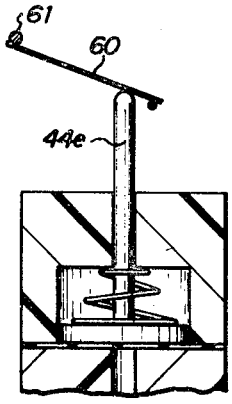
FIG. 6 is a sectional view of a sensor block taken along lines 6—6 of FIG. 4.
Figure 7:
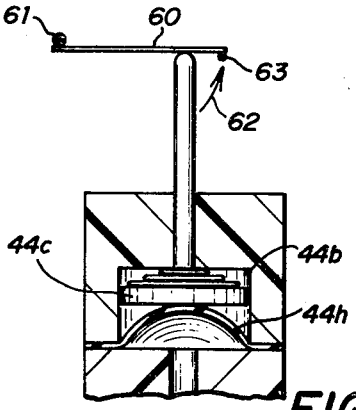
FIG. 7 is the same section as FIG. 6 illustrating an actuated sensor position.

As shown in FIGS. 6 and 7, the rod 44*e* (along with like rods in the sensor assembly 44) is positioned to actuate a pivoted plate 60. Plate 60 is pivoted on a rod 61 and is moved from a rest position shown in FIG. 6 to a tally position shown in FIG. 7, the movement being in the direction of arrow 62 as diaphragm 44*h* is forced up into chamber 44*b*, moving piston 44*c* upward. Plate 60 carries an actuating rod 63 extending along the edge thereof opposite pivot rod 61. Rod 63 serves to actuate a mechanical counter with print wheels manufactured and sold by Veeder Root, Inc. of Hartford, Conn. and identified as Series 1122, as will be shown in connection with FIG. 8.

Figure 8:
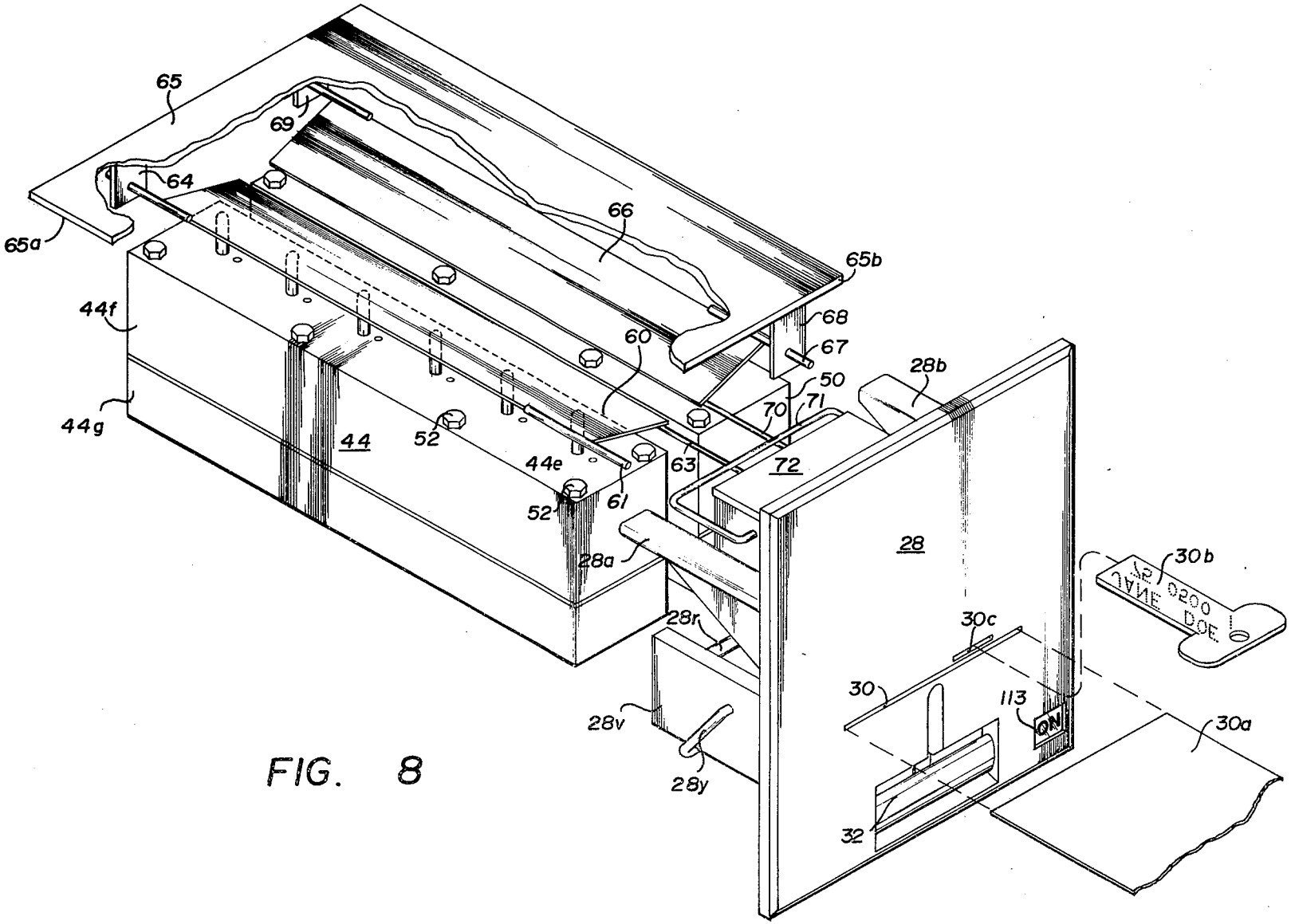
FIG. 8 is an isometric view of the sensor-tally mechanism.

In FIG. 8, it will be noted that rod 61 which pivots plate 60 is journaled in a pair of brackets, one of which, rear bracket 64, is shown extending from beneath a sensor mounting plate 65. The front end of the rod 61 is similarly journaled. Plate 60 normally slopes downward with the under surface thereof resting on the upper ends of the rods such as the rod 44*e*.

In a similar manner, a second plate 66 is pivotally mounted on a rod 67 journaled in front bracket 68 and rear bracket 69. Plate 66 slopes downward and rests on the top of rods extending upward from the sensor assembly 50. An acutating rod 70 is secured to the free edge of the plate 66 and extends beyond the front end of assemblies 44 and 50. Thus, any time a button is actuated in the set 20, FIG. 1, and as a consequence thereof liquid is passed through any chamber in either of assemblies 44 or 50, then plate 60 or plate 66 will be driven upwardly, moving rod 63 or rod 70 upwardly.

Rods 63 and 70 coact with tally unit 28 in order to increment counters mounted therein. More particularly, as shown in FIG. 8, rods 63 and 70 extend beneath an incrementing lever 71 of a counter 72 mounted adjacent the rear of the face plate of the tally unit 28.

The sensor assembly suspended from plate 65 is mounted in housing 12 by sliding the plate with the edges 65*a* and 65*b* thereof nesting in slideway in structure depending from the top of module 10*a*. Similarly, the tally unit 28 is provided with brackets 28*a* and 28*b* which have outwardly directed horizontal flanges which pass immediately outside the front bracket such as bracket 68 and abut the front ends of the edge strips 65*a* and 65*b* to be supported with the sensor assemblies 44 and 50.

The tally unit 28 may be provided with two counters one of which has a printer associated with it and the other observable through a slot in the face plate of tally unit 28. Only one such counter, the printer counter, will here be described.

Slot 30 is provided for the insertion of a card 30*a* so that the counter total can be printed on the card at the beginning of the days operation and at the end of a days operation. A key 30*b* is provided for registering in a key slot 30*c* so that personnel identification data thereon may be printed on the same card.

Further details of the tally unit are shown in FIGS. 9–12.

Figure 9:
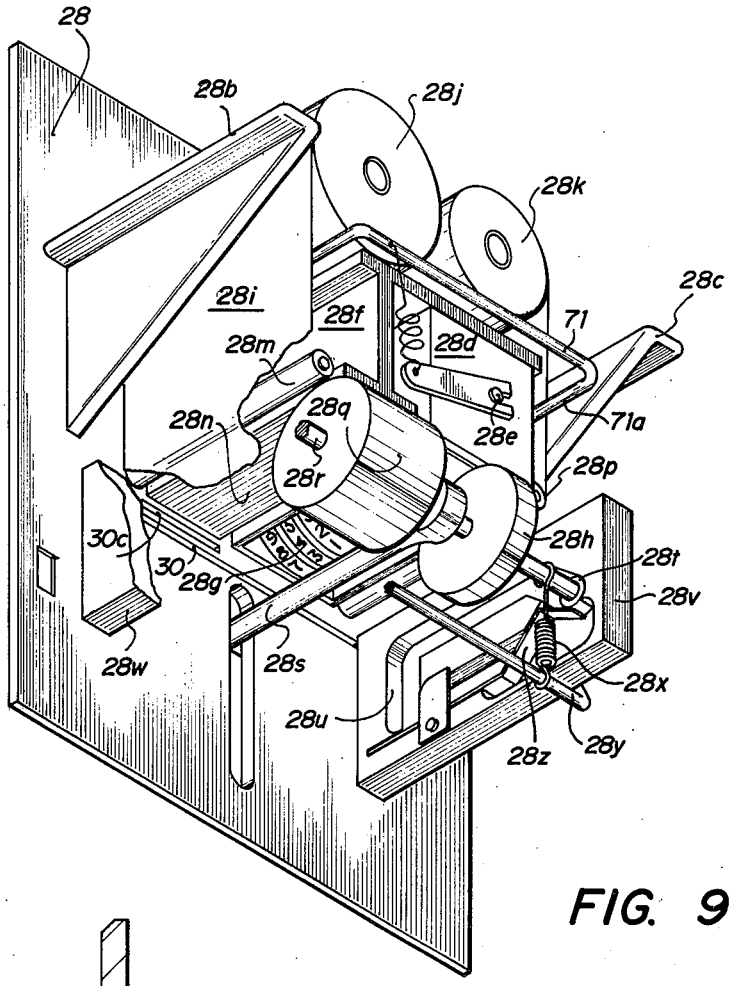
FIG. 9 is an isometric view illustrating the tabulator and printer elements.

Referring to FIG. 9, tally unit 28 is partially illustrated looking upward and forward from the lower right rear zone of the device. Tally unit 28 includes the support brackets 28*b* and 28*c* previously described. Central to the unit is counter 28*d* in which number wheels 28*g* are mounted on a shaft 28*e*. Counter 28*d* is mounted on a bracket 28*f* which is secured to the face plate of tally unit 28. An actuating arm 71 extends rearwardly generally perpendicular to the face plate of tally unit 28. The forward extending portion 17*a* of arm 71 is secured to the actuating shaft of counter 28*d* so that each time either plate 60 or plate 66 of FIG. 8 is actuated, counter 28*d* will be incremented. Number wheels 28*g* are seen at the bottom of the counter unit 28*e* facing downward.

Counter 28*d* is positioned relative to a roller 28*h* such that the total registered by counter 28 may be printed on a paper tape 28*i* which is fed from supply roll 28*j* and which is taken up on a takeup roll 28*k*. Rolls 28*j* and 28*k* have been omitted from FIG. 8. Tape 28*i* passes downward from roll 28*j* over a guide roller 28*m* and thence horizontally across the face of a flat anvil 28*n* which is part of bracket 28*f*. The tape 28*i* then passes underneath the number wheels 28*g* over a roller 28*p* and then upward to the takeup roll 28*k*.

Roller 28*h* together with a roller 38*q* are mounted on a shaft 28*r*. Handle 32, FIGS. 1 and 8, recessed in a slot in the face plate of tally unit 28, is connected by a rod 28*s* to shaft 28*r*. When handle 32 is grasped by an operator and pulled forward, rollers 28*h* and 28*q* move forward toward the face plate of tally unit 28 causing the total represented by the position of the number wheels to be printed on tape 28*i*. At the same time the total is printed on the card inserted through slot 30.

Key 30*b* represents an ID card for the operator having raised alphanumeric symbols thereon. When key 30*b* is inserted through slot 30*c*, any information embossed in the lower face thereof will also be printed on tape 28*i* and upon a tally card inserted through slot 30 as the roller 28*q* moves along platen 28*n*.

It will be noted that the end of the shaft 28*r* carries a roller 28*t* which travels in a groove 28*u* on the inside face of a guide plate 28*v*. A companion guide plate 28*w* is similarly mounted and is similarly grooved to receive a roller (not shown) on the end of shaft 28*r* opposite the end carrying roller 28*t*. As the shaft 28*r* is pulled forward through forces applied through rod 28*s*, the rollers 28*t* move upwardly and forward towards the face plate of tally unit 28*a*. The course of the groove 28*u* forces rollers 28*h* and 28*q* against the number wheels 28*g* and key 30*b*, respectively. As rod 28*s* is pulled forward, the roller 28*t* is moved forward and then downward under the force of a spring 28*x*. Spring 28*x* is anchored at one end to the shaft 28*r* and at the other end to a pivoted rod 28*y*. A leaf spring 28*z* is secured along the bottom of the lower course of groove 28*u* and has an upwardly deflected portion so that as the shaft 28*r* is pushed backwards away from the face plate of tally unit 28 to its normal arrest position, the roller 28*t* is forced upwardly to home position shown in FIG. 9.

Figure 10:
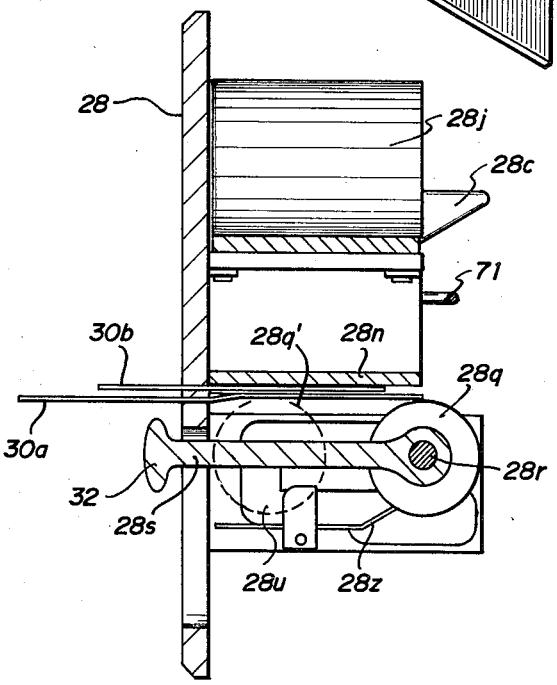
FIG. 10 is a longitudinal sectional view of the printer of FIG. 9.

In the sectional view of FIG. 10, the system is shown in solid lines with the key 30*b* and tally sheet 30*a* inserted into the appropriate slots. The dotted circle 28*q'* indicates another location of the roller 28*q* in the course of movement of the shaft 28*r* along groove 28*u*.

Referring now to FIG. 2, the face plate of tally unit 28 has been shown partially cut away to show angle strips 100 and 101 mounted to the frame of module 10*a* to form a slideway. Edge strip 65*b* of plate 65, FIG. 8, slides into the way thus formed and is followed by bracket 28*b*, FIGS. 8 and 9, to provide the support and mounting within module 10*a* for the sensor assembly and the tally unit generally in the positional relationship illustrated in FIG. 8.

Figure 12:
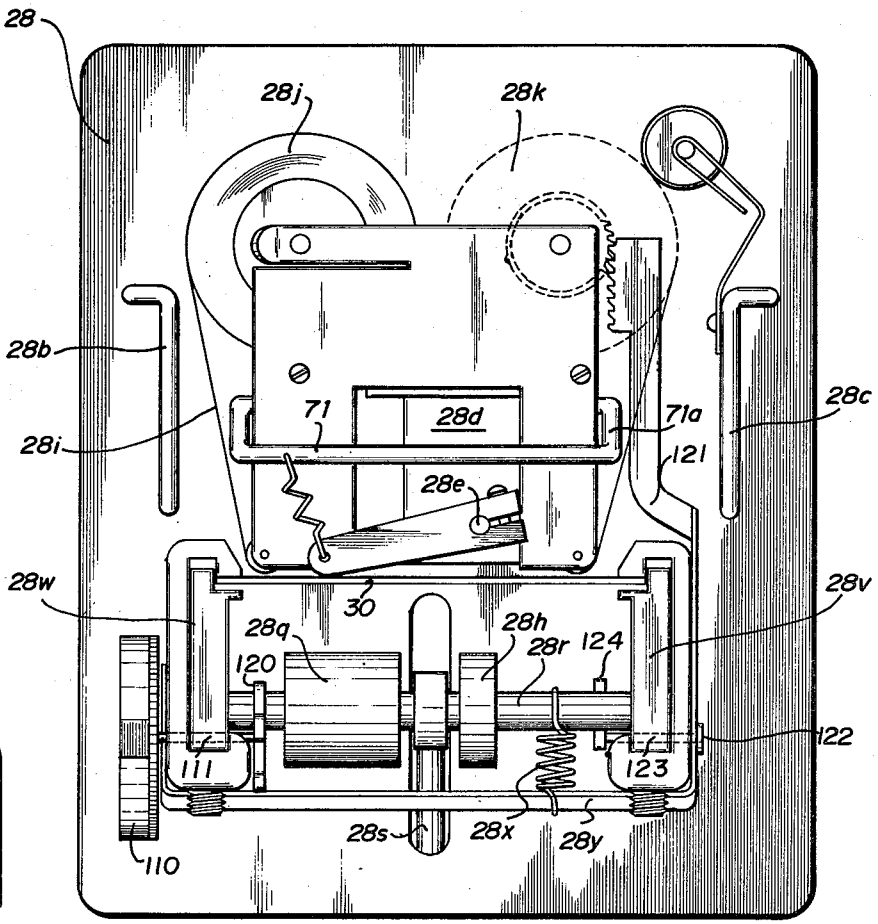
FIG. 12 is a rear view of the unit of FIG. 11 with the gas valve removed.
Figure 11:
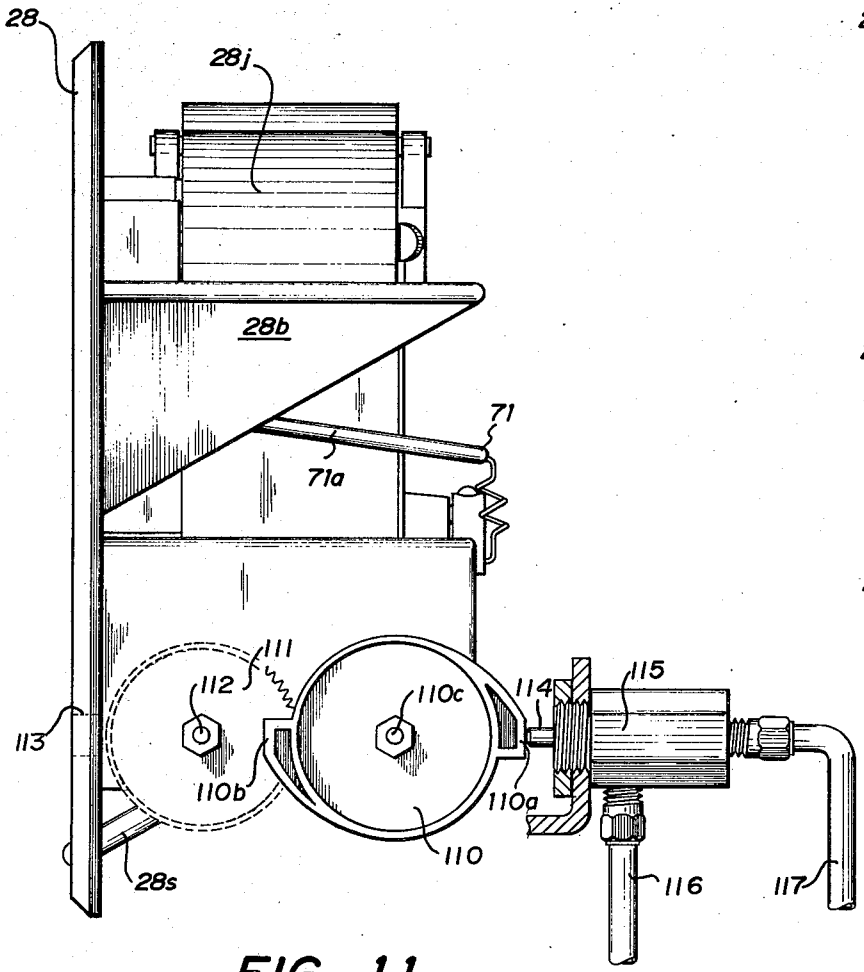
FIG. 11 is a side view of the recording unit showing gas control.

Referring now to FIGS. 11 and 12, further details of the recording unit 28 are illustrated. As shown in FIG. 11, a cam wheel 110 is mounted on a shaft 110*c* and has two steps 110*a* and 110*b* on an otherwise circular periphery. A gear is integral with and located on the back of the cam wheel 110. Such gear meshes with a gear on a display wheel 111. Wheel 111 is mounted on shaft 112 and has a wide periphery a portion of which may be viewed through a window 113 in the face plate 28.

As will be understood in connection with FIG. 12, the cam wheel 110 and the display wheel 111 will be rotated 90° upon execution of each printing operation effected by pulling handle 32, FIG. 10, forward to print and then pushing it backwards to return the print wheel 28*q* to its home position.

The periphery of the cam wheel 110 faces an actuating piston 114 of a gas valve 115. Valve 115 is mounted on a suitable bracket to be fixed in relation to the back of recording unit 28. Pressurized gas such as Freon is supplied by way of an inlet pipe 116 for flow by way of line 117 to operating parts of the system when valve 115 is open. When valve 115 is closed, the pressurized gas is removed from all piping joints and fixtures in the system downstream of valve 115.

The cam wheel 110 operates in conjunction with valve 115 so that peculation may be prevented. More particularly, at the beginning of a flight module 12 is placed in cart 10, FIG. 1. The system is readied for operation with valve 115 closed. Operating personnel then insert tally card 30*a* and ID key 30*b*, FIG. 8, into the respective slots and then execute a printing operation. As the print wheel is returned home, the printing operation is completed and the cam wheel 110 is rotated 90°, thereby opening valve 115. During flight, each drink dispensed is registered on the counter unit by actuation of the arm 71. With flight complete, the operator again inserts the tally card 30*a* and the ID key 30*b* and executes a printing operation at the close of which the cam wheel 110 is rotated 90° closing valve 115. Thus, the attendant has the beginning count and the end count registered on the card 30*a*. The same information is also recorded on the tape 28*i*. With the valve 115 open, the legend ON, FIG. 8, appears in window 113. This legend is printed on the surface of the gear wheel 111 at two locations 180° apart. Similarly, the legent OFF is printed at locations 180° apart and respectively 90° from the location of the ON legend.

Referring to FIG. 12, the actuation of the cam wheel 110 is carried out by mounting a star wheel 120 on shaft 110*c*. The star wheel has four arms on it one of which always extends up into the path of shaft 28*r*. As shaft 28*r* is pushed to the rear of the recording unit, it encounters one of the arms on the star wheel 120 rotating shaft 110*c* and cam wheel 110 90°.

Provision is made also to advance the tape 28*i* from the supply roll 28*j* to the takeup roll 28*k*. This is accomplished by an arm 121 which is adapted to be moved upwards in response to rotation of an arm 122 mounted on a shaft 123. An arm 124 is mounted on the inboard end of shaft 123 and is rotated 90° each time the shaft 28*r* is returned to its home position. The rotational motion of shaft 123 is then transmitted by way of crank arm 122 to arm 121 to elevate the same. After the shaft 28*r* passes arm 124, the bar 121 drops back to its home position.

From the foregoing, it will be seen that with the module 10*a* locked in cart 10 with the valve 115 initially closed by personnel preparing module 10*a* for operation, no drinks can be dispensed from module 10*a* until a flight attendant has completed a printing operation, i.e., until valve 115 has been opened in the course of completion of a printing operation as above described. Thereafter, during the course of a flight, drinks may be dispensed, each being registered on the counter 28*d*. At the end of the flight, a second printing operation is executed in the course of which valve 115 is again closed so that no further dispensing operations can be conducted, except that there be another printing operation. All data relating to all drinks dispensed are thus recorded on tape 28*i* as well as on the card inserted by the attendant.

Having described the invention in connection with certain specific embodiments thereof, it is to be understood that further modifications may now suggest themselves to those skilled in the art and it is intended to cover such modifications as fall within the scope of the appended claims.

What is claimed is:

1. In a beverage dispenser in which measured quantity of liquid is drawn from a supply container and dispensed through an output line leading from said measuring means, the combination which comprises:

a. counter means having an input actuator to increment said counter, and b. means responsive only to liquid pressure connected to said output line for actuating said counter once for each delivery of liquid through said output line.

2. In a beverage dispenser in which measured quantity of liquid is drawn from a supply container and dispensed through an output line leading from said measuring means, the combination which comprises:

a. counter means having an input actuator to increment said counter, and b. pressure responsive means which comprises a housing defining a chamber having fill and discharge ports communicating therewith, connected in series in said discharge line, a flexible diaphragm extending across said chamber to deflect upon entry of liquid into said chamber, and means responsive to deflection of said diaphragm for actuating said counter means.

3. The sensor as defined in claim 2 wherein said fill and discharge ports sized to cause liquids to accumulate in said chamber under said diaphragm when liquids move through said discharge line and prevent air flowing through the discharge line from actuating said counter.

4. An apparatus as defined in claim 1 wherein said counter means include manually actuated printer means and further structure responsive to successive print operations alternately to apply and remove said pressure from said system.

5. In a liquid dispensing system having a container for a volume of liquid, a discharge conduit with a check valve therein communicating with the interior of said container, and a positive displacement measuring and dispensing valve means connected to said discharge conduit for removing a set quantity of liquid from said container and for positively pumping said set quantity of liquid from said valve means, the combination comprising:

a. a pressure responsive sensor means for sensing the flow of liquid from said valve means,
b. a conduit connecting said valve means and said sensor means,
c. a check valve in said conduit located between said valve means and said sensor means,
d. said sensor means comprising a housing having a chamber therein with fill and discharge ports communicating therewith,
e. means connecting said ports in series in said conduit,
f. a flexible diaphragm extending across said chamber adjacent to said fill and discharge ports, sized to cause the accumulation of liquid in said chamber when said valve means pumps liquid through said sensor means,
g. a piston positioned in said chamber in contact with said flexible diaphragm on the side opposite said fill and discharge ports,
h. a rod extending from said piston,
i. a follower plate positioned in contact with said piston rod, said plate being mounted to pivot about a horizontal axis,
j. an actuator finger extending from said follower plate,
k. counter means having an input actuator contacted by said finger whereby said counter means is incremented by each movement of said follower plate, and
l. means to print the state of said counter.

6. The combination set forth in claim 5 in which:

a. a roller is mounted to travel over the face of said counter, and
b. a handle extends from said roller for moving said roller against said counter whereby a sheet of record material between said counter and said roller will be imprinted with the information on said counter.

7. In a dispensing system for dispensing successive liquid quantities selected from a plurality of separate liquid storage units comprising:

a. a separate positive displacement liquid measuring and dispensing means connected to each said unit for moving successive quantities of selected liquids through a discharge conduit,
b. a counter means having an input actuator to increment said counter, and
c. a plurality of means responsive only to liquid pressure, one connected in each of said discharge conduits for actuating said counter once upon delivery of each said quantities.

8. In a dispensing system for dispensing successive liquid quantities selected from a plurality of separate liquid storage units comprising:

a. a separate positive displacement liquid measuring and dispensing means connected to each said unit for moving successive quantities of selected liquids through a discharge conduit,
b. a counter means having an input actuator to increment said counter, and
c. pressure response means which comprises:
   1. a first plate in which a plurality of spaced wells are formed in a bottom face thereof;
   2. a flexible diaphragm extending across said bottom face,
   3. a second plate secured to said first plate with said diaphragm clamped therebetween with fill and discharge ports leading to and from with the face of said diaphragm opposite each said well, and
   4. piston means in each said well for sensing deflection of said diaphragm and for actuating said counter, said fill and discharge ports being sized whereby liquids entering said chamber from said fill port will accumulate therein during discharge whereby said diaphragm will be deflected.

9. The device defined in claim 8 wherein said housing comprised of said upper and lower plates has cylindrical wells therein, a pivoted follower plate aligned with and positioned above said upper plate, and piston means in each said aligned well contacts said plate for motion transfer to actuate said counter.

10. The apparatus of claim 8 wherein a piston in each of said chambers rests on said diaphragm on the side opposite said fill and discharge ports with piston rods extending from each of said pistons through said upper plate to actuate said follower plate.

11. A secured liquor dispensing system which comprises:

a. a locked module for receiving liquor containers and a pressurized gas source with a multiple channel dispenser protruding therefrom,
b. a counter-printer in said module having actuating means extending from said module to print a numerical total registered on a counter of said counter-printer,
c. metering liquor pump means connected between said containers and said dispenser and adapted to be powered from said gas source in response to actuation of said dispenser and connected to increment said counter upon delivery of each metered quantity of liquor to said dispenser, and
d. means responsive to successive print operations of said counter-printer alternately to apply pressure from said source to said pump means and remove pressure from said source from said pump means.

12. The combination set forth in claim 11 in which said metering liquor pump means includes means for discriminating between movement of liquid therethrough from any of said containers before exhaustion of the supply therein and the movement of air after exhaustion of such supply.

* * * * *